United States Patent [19]

Wycliffe

[11] 3,936,238

[45] Feb. 3, 1976

[54] ROTARY COMPRESSORS

[75] Inventor: Henryk Wycliffe, Crawley, England

[73] Assignee: BOC Limited, trading as Edwards High Vacuum International, Crawley, England

[22] Filed: May 8, 1974

[21] Appl. No.: 467,924

[30] Foreign Application Priority Data

May 9, 1973 United Kingdom ..... 22247/73

[52] U.S. Cl. ..... 417/312; 417/363; 418/97; 418/149; 418/181

[51] Int. Cl.² ..... F04B 17/00

[58] Field of Search ..... 418/97, 98, 99, 149, 181, 418/270; 417/312, 313, 363

[56] References Cited

UNITED STATES PATENTS

| | | | |
|---|---|---|---|
| 2,291,346 | 7/1942 | Robinson | 417/363 |
| 2,634,904 | 4/1953 | Clerc | 418/99 X |
| 2,928,961 | 3/1960 | Morrill | 417/363 X |
| 3,604,820 | 9/1971 | Scheller | 417/363 |
| 3,744,942 | 7/1973 | Mount | 418/99 X |

*Primary Examiner*—C. J. Husar
*Assistant Examiner*—Leonard Smith
*Attorney, Agent, or Firm*—Dennison, Dennison, Meserole & Pollack

[57] ABSTRACT

A high-speed rotary vacuum pump has a compression chamber which is spaced from the walls of a housing by at least one body of acoustic insulation material which acts to absorb noise, to position the chamber with respect to the housing, and to form a fluid-tight seal between the chamber and the housing in the region where the rotary drive shaft of the pump projects from the compression chamber. The drive shaft and the gas inlet and outlet ducts are also acoustically insulated.

19 Claims, 5 Drawing Figures

ROTARY COMPRESSORS

This invention relates to a rotary compressor for gas, particularly, but not exclusively, of the sliding vane type.

By the term 'compressor' in this specification is meant both a device for compressing gas at atmospheric pressure and delivering it at a superatmospheric pressure, and a device (usually termed a vacuum pump) for compressing gas at a sub-atmospheric pressure and delivering it at a pressure at or near atmospheric.

One of the major sources of noise from a rotary compressor is the vibrations imparted to the compression chamber walls by high-speed movement of the rotor vanes, by hydraulic 'knock' in the sealing oil, etc.

The present invention aims at producing a quiet, high-speed, rotary compressor by acoustically insulating the external surfaces of the compression chamber from the ambient atmosphere.

Accordingly the present invention provides an oil-sealed, rotary compressor which is as claimed in the appended claims.

The present invention will now be described by way of example with reference to the accompanying drawings, in which.

Figure 1:
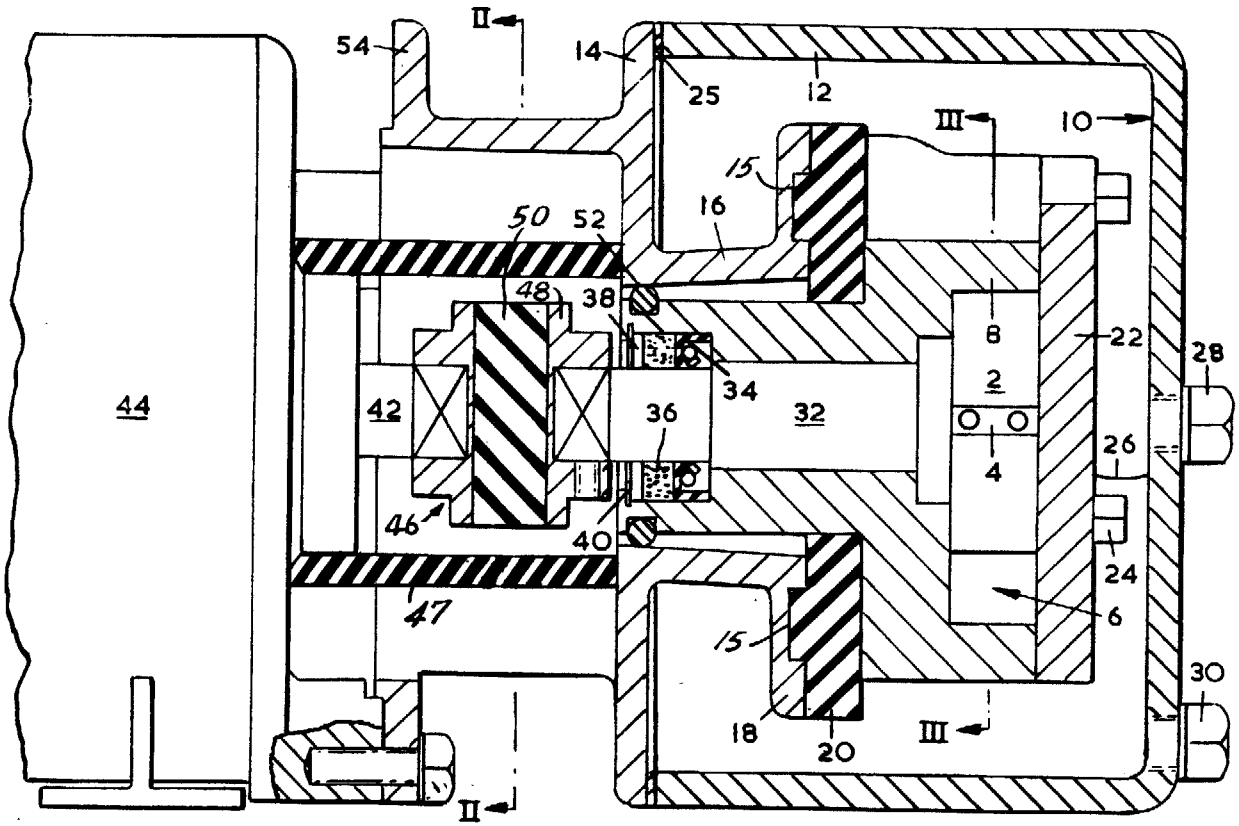
FIG. 1 is a view, part in section and part in elevation, of a compressor of the present invention in the form of a sliding-vane rotary vacuum pump coupled to an electric motor.

In the accompanying drawings, those parts common to the various Figures have been given the same references.

The rotor 2 of the illustrated pump carries a pair of diametrically-opposed vanes 4, the rotor and vanes being mounted within an eccentric compression chamber 6 formed in a compression chamber housing 8. Compression chamber housing 8 is supported in the interior of a sump housing 10 in the form of a cup-shaped member 12 cooperating with an end wall 14. End wall 14 has an inner tubular projection 16 terminating in an annular flange 18. Positioned between the opposing faces of flange 18 and compression chamber housing 8 is a vibration barrier 20 of rubber or like elastomeric material. Although the barrier 20 is shown as having planar surfaces in contact with the adjacent metal members over a relatively-large surface area, in practice the contacting surfaces would be designed to be as small as possible to leave pockets of air between barrier 20 and the adjacent metal surfaces. These pockets add to the vibration insulation by making the barrier 20 'squashy' so that vibrations applied to one major surface of it by the compression chamber housing 8 are virtually all absorbed in the interior of barrier 20 without being mechanically transmitted to the face in contact with flange 18.

It is also envisaged that one or other of the major surfaces of barrier 20 would have projections or indentations 15 permitting it to key with the adjacent members of the pump assembly so that the compression chamber housing 8 is positively located in the correct position when the pump is being assembled.

One wall of chamber 6 is defined by an end plate 22 secured to the chamber housing 8 by screws 24. Cup 12 is secured to end wall 14 in a fluid-tight manner by the interposition of a gasket 25 of rubber or other suitable material which is not subject to attack by the oil or other liquid which is used in the vacuum pump for lubrication and sealing purposes. The interior of sump housing 10 is intended to act both as an oil-spray setting chamber and as a sump for the oil which is arranged (by means which are not shown) to be continuously introduced at a desired rate into the interior of chamber 6, being exhausted therefrom in operation of the pump and falling back into the sump. The upper level of the oil is indicated at 26 and is determined by the location of a screw-threaded filling plug 28 positioned in cup 12. To minimise the transmission of vibrations through the oil, the oil level is kept low. When desired, the oil or like fluid can be exhausted from the interior of sump housing 10 by removal of a like plug 30.

Extending from rotor 2 is a driving shaft 32 provided with shaft seals 34 and additional acoustic insulation 36 held in place by a washer 38 and a circlip 40. The end of shaft 32 is connected to the shaft 42 of an associated electric motor 44 by means of a flexible coupling 46. This is preferably of a type which employs rubber or other elastomer for transmitting drive to the rotor, so that the transfer through the coupling of vibrations at audible frequencies is impeded. The coupling can be of fairly-conventional construction, and can be in the form of a pair of spiders 48 of which each is non-rotatably secured to the outer end of its respective shaft. Extending from each spider is a pair of fingers, the two pairs of fingers from the spiders gripping a cruciform coupling member 50 of rubber or other elastomeric material. Alternatively, a boss may be secured to each of the two shafts and these may be connected together by a cylindrical elastomeric member having its faces bonded to the faces of the bosses. The coupling is such that it is able transmit torque but absorb both axial and angular vibrations of shaft 32 relative to shaft 42.

Positioned between adjacent, virtually-cylindrical, surfaces of end wall 14 and the chamber housing 8 is an O-ring 52. In addition to acting as a device for centering the chamber housing 8 in the passage defined by projection 16, O-ring 52 acts as acoustic insulation.

Projecting from the outer face of end wall 14 is an arcuate shroud 54. As can be seen most clearly from FIG. 2, shroud 54 encircles most of coupling 46 and has two main functions. One is to shield the rotating shafts 42 and 32, and coupling 46, from accidental contact with the clothing or limbs of people using the vacuum pump. The other function is to muffle to an extent any 'noise' which is still able to reach the outside of the vacuum pump despite the measures taken against it. The compressor drive shaft is a likely source of such noise because the shaft passes through the acoustically-dense wall of the housing and is directly connected to the rotor, and so is vibrated by it. The dgreee of muffling is increased if shroud 54 forms a complete envelope, around the coupling but this is not always possible because of the danger of motor 44 becoming overheated. For this reason part of the shroud may be cut away to act as an inlet by which cooling air can pass through the resultant gap into the interior of motor 44. Nevertheless, because of the location of the cut-away portion, any noise coming from the interior of the vacuum pump tends to be directed down towards the floor or other surface supporting the vacuum pump and its driving motor, and so be absorbed there rather than passing directly to the ears of the users. It is also possible to line the interior of the shroud with sound-absorbent material to reduce the escape of reflected sound through the bottom aperture.

Yet other methods of acoustically insulating the shaft could be used. For instance, the shaft and flexible coupling could be enclosed in a sleeve 47 of felt or like vibration-absorption material which would be positioned so as still to allow the desired flow of cooling air into the interior of the electric motor. As an alternative, the sump housing 10 could be redesigned so that the flexible coupling is positioned inside the sump housing with the oil-seals and vibration-absorbers being positioned on the drive shaft 42 instead of on the compressor shaft 32.

Figure 2:
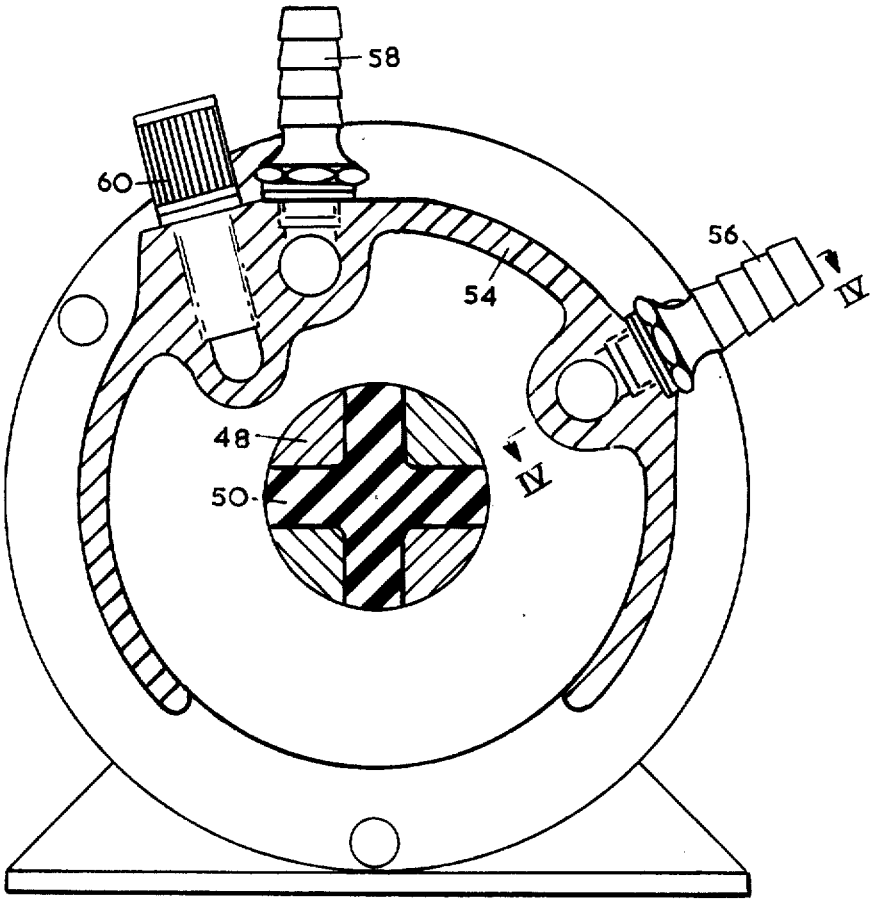
FIG. 2 is a view in the plane II—II of FIG. 1.

As indicated in FIG. 2, the shroud 54 also supports an inlet 56 for the gas being pumped; an outlet 58 for the gas being exhausted from the pump, and a ballast knob 60 by means of which air can be allowed to 'leak' at a controlled rate into the chamber of the pump for gas-ballasting purposes, as is well known in the vacuum pump art.

Normally the end wall 14 of the sump housing and the pumping chamber housing 8 are made from metal. In order to prevent the vibrations of housing 8 from being transmitted to the exterior of the pump assembly it is important that there is no direct metal-to-metal path along which vibrations can flow. However, this militates against the fact that there must be continuity in the walls of the ducts along which gas flows to the pumping chamber.

Figure 4:
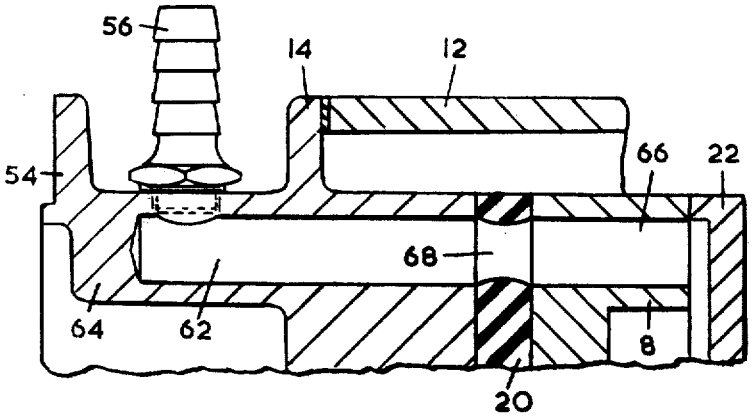
FIG. 4 is a view in plane IV—IV of FIG. 2.

FIG. 4 shows one manner in which these requirements are met. FIG. 4 is a cross-section along the gas inlet duct, and similar arrangements are made for the gas ballasting duct. As shown, the gas inlet 56 leads to a duct 62 machined in a thickened portion 64 of shroud 54. Duct 62 is substantially coaxial with a similar duct 66 provided in the chamber housing 8, and both ducts are in communication with each other through a passage 68 extending through the thickness of barrier 20. Barrier 20 functions both to provide a gas-tight connection between the adjacent ends of ducts 62 and 66 and also as vibration insulation in preventing, at least to a large extent, audible vibrations of the chamber housing 8 from being transmitted to the end wall 14 and integral portions thereof. Internally of the chamber housing 8, duuct 66 is placed in communicationn with the pumping chamber 6 in a way which is conventional and which will therefore not be described herein in any further detail.

Figure 3:
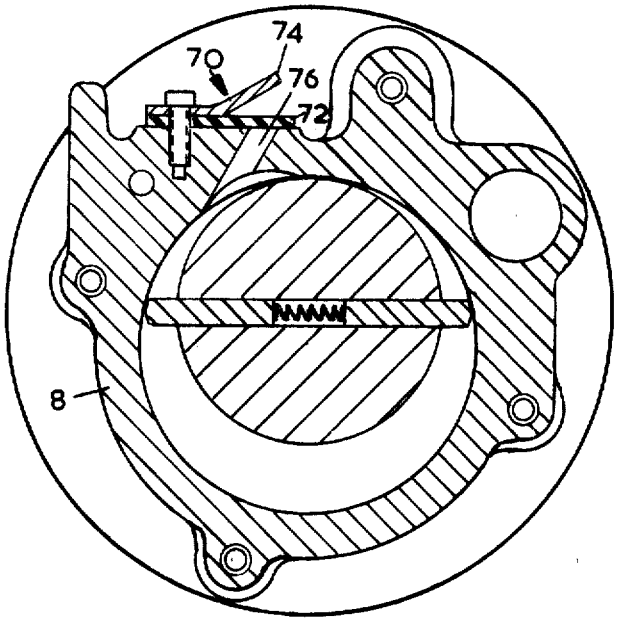
FIG. 3 is a view in plane III—III of FIG. 1.

For sake of completeness, FIG. 3 shows the internal construction of the vacuum pump itself. Most parts are self-explanatory taken in conjunction with the preceding description. The only component not so far shown or referred to is the exhaust valve 70. This consists of a flap 72 of rubber or other elastomeric material, and a restraining member 74 adapted to limit the extent of flexure of flap 72 so that the latter does not become permanently distorted in use. The flap 72 seals the outer end of an exhaust passage 76 in the chamber housing 8. When the pump is operating, a mixture of gas and vacuum oil is impelled along the passage 76, through valve 70, and into the interior of the sump housing 10, from where the gas is vented to the exhaust outlet 58, and the oil returns to the sump.

Figure 5:
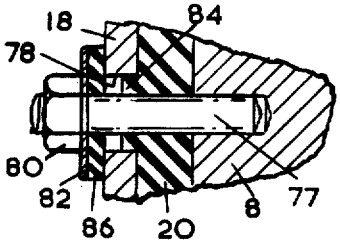
FIG. 5 is a sectional view through a bolt used for securing the compression chamber housing to the sump housing.

As shown in FIG. 5, the chamber housing body member 8 is secured to the housing by means of several bolts 77 projecting from the chamber housing body 8 and passing through apertures 78 in flange 18, where they are engaged by nuts 80 bearing on metal washers 82. As the nuts 80 are screwed down they force the chamber housing 8 to move along the axis of shaft 32 into engagement with the barrier 20 and O-ring seal 52. Although the bolts 77 also act to prevent the chamber housing 8 from rotating with shaft 32, they are prevented from coming into direct contact with flange 18 by extensions 84 integral with barrier 20 and rubber wahsers 86 under the metal washers 82, so that the intervening rubber acts to absorb the vibrations in bolts 77 from being transmitted to flange 18, and from there to the rest of the sump housing 10. Alternatively, the chamber housing 8 may be forced against flange 18 by a pad of elastomeric material which is compressed and located between cover plate 22 and the sump housing 10.

Accordingly it will be seen that the present invention provides a rotary compressor in which appreciable attention has been paid to absorbing sound vibrations generated in operation of the compressor before they are able to be transmitted to the exterior surfaces of the compressor and generate a noise. The provision of quiet vacuum pumps and other compressors is particularly important for hospitals and educational establishments where it is important to keep the background noise level to as low value as possible.

I claim:

1. An oil sealed rotary compressor including a sealed sump housing having acoustically-dense walls and acting as an oil sump, a compression chamber housing positioned in the interior of the sealed sump housing, all external surfaces of the chamber housing being spaced from the adjacent surfaces of the sump housing and separated therefrom by an insulating material at points of interconnection between said sump housing and said chamber housing to absorb vibration between said housings, a rotor, mounted for rotation within the compression chamber, a rotary drive shaft connected to the rotor, which drive shaft projects from the chamber, means for driving the rotary drive shaft, and at least one body of vibration insulation located between the chamber housing and the sump housing, in which the vibration insulation is adapted to locate and support the chamber housing within the sump housing, and to form a fluid-tight seal between the chamber housing and the sump housing in the region where the rotary drive shaft projects from the chamber housing.

2. A compressor as claimed in claim 1, in which the surfaces of the body and the housing which are in contact with each other have corresponding projections and indentations so that the body is positively located with respect to the housing.

3. A compressor as claimed in claim 1, in which the surfaces of the body and the chamber which are in contact with each other have corresponding projections and indentations so that the body is positively located with respect to the chamber.

4. A compressor as claimed in claim 1, in which the wall of a first duct through which the gas being pumped enters the chamber has a complete peripheral portion made of vibration insulation material.

5. A compressor as claimed in claim 1, in which the wall of a second duct through which the gas being pumped leaves the chamber has a complete peripheral portion made of vibration insulation material.

6. A compressor as claimed in claim 1, in which the ducts through which the gas enters and leaves the chamber pass through the body of vibration insulation material, which body forms complete peripheral portions of the duct wall.

7. A compressor as claimed in claim 1, in which the wall of the sump housing through which the drive shaft passes has extending inwardly a tubular projection which terminates in an annular flange, and in which the body is positioned between the flange and the adjacent external wall of the chamber housing.

8. A compressor as claimed in claim 7, in which the chamber housing is secured to the sump housing by a plurality of bolts which project from the external surface of the chamber housing and extend through apertures in the chamber housing and the flange, and in which the ends of the bolts are engaged by nuts which are separated from the flange by an elastomeric material.

9. A compressor as claimed in claim 7, in which the chamber housing has a tubular projection which extends into the tubular projection of the sump housing and is spaced therefrom and sealed thereto by an O-ring made of an vibration insulation material.

10. A compressor as claimed in claim 1, in which the means for driving the rotary drive shaft include a motor, a motor drive shaft, and a flexible coupling, having a coupling member made of an elastomeric material having good vibration insulation characteristics, in which the motor is adapted to drive the motor drive shaft, and the motor drive shaft is coupled to the rotary drive shaft by the flexible coupling.

11. A compressor as claimed in claim 10, in which the flexible coupling is located inside the sump housing, and in which the motor drive shaft is sealed to the adjacent wall of the chamber housing by a seal made of a material having good vibration insulation characteristics.

12. A compressor as claimed in claim 10, in which the flexible coupling is located outside the sump housing and the compressor drive shaft is sealed to the adjacent wall of the chamber housing by a seal made of a material having good vibration insulation characteristics.

13. A compressor as claimed in claim 12, in which a noise suppressing wall, at least partically encircles the flexible coupling.

14. A compressor as claimed in claim 12, in which a sleeve encloses the flexible coupling.

15. An oil sealed rotary compressor, including:

a sealed sump housing acting as an oil sump;

a chamber housing defining a compression chamber and positioned in the interior of the sealed sump housing, the external surfaces of the chamber housing being spaced inwardly from the adjacent surfaces of the sump housing;

a rotor mounted for rotation within the compression chamber, and rotatable with a drive shaft projecting from the chamber housing;

means for driving the drive shaft through vibration-absorbing means;

at least one duct extending between the compression chamber housing and means mounted on the sump housing for coupling the ducts to equipment containing the fluid to be compressed, and at least one body of vibration insulation material positioned between the chamber housing and the sump housing at all points of interconnection, and between the chamber housing and the duct coupling means at all points of interconnection whereby no metal-to-metal vibration-transmitting contact between any component carried by, or forming part of, the chamber housing, and the sump housing or any other component external to the chamber housing is present.

16. A rotary compressor as claimed in claim 15, in which one body of vibration insulation material takes the form of a mounting pad of rubber or like elastomeric material positioned between the chamber housing and the sump housing, and in which the said duct passes through the mounting pad.

17. A rotary compressor as claimed in claim 16, in which the drive shaft is coupled to its driving means through at least one body of elastomeric material.

18. A rotary compressor as claimed in claim 15, in which a second duct extends from the compression chamber to means mounted on the sump housing for conducting gas at a controlled rate to the interior of the compression chamber for gas ballasting purposes.

19. A rotary compressor as claimed in claim 18, in which one body of vibration insulation material takes the form of a mounting pad of elastomeric material positioned between the chamber housing and the sump housing, and in which both of the said ducts pass through the mounting pad.

* * * * *